US012178346B2

(12) United States Patent
Lemieux

(10) Patent No.: US 12,178,346 B2
(45) **Date of Patent: *Dec. 31, 2024**

(54) SELF-MAKING BEDDING SYSTEM, METHOD AND KIT THEREOF

(71) Applicant: 9381-6031 Québec Inc., Longueuil (CA)

(72) Inventor: Marc-André Lemieux, Longueuil (CA)

(73) Assignee: 9381-6031 Québec Inc., Longueuil (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/101,811

(22) Filed: Jan. 26, 2023

(65) Prior Publication Data

US 2023/0255370 A1 Aug. 17, 2023

Related U.S. Application Data

(63) Continuation of application No. 16/340,279, filed as application No. PCT/CA2017/051199 on Jun. 10, 2017, now Pat. No. 11,564,512.

(Continued)

(51) Int. Cl.

| | |
|---|---|
| ***A47G 9/02*** | (2006.01) |
| ***A47C 21/02*** | (2006.01) |
| ***A47G 9/00*** | (2006.01) |

(52) U.S. Cl.

CPC ..... *A47G 9/0207* (2013.01); *A47C 21/028* (2013.01); *A47G 2009/003* (2013.01); *A47G 9/0261* (2013.01); *A47G 2009/0269* (2013.01)

(58) Field of Classification Search

CPC ..... A47G 9/0207; A47G 9/0261; A47G 2009/003; A47G 2009/0269; A47G 9/023; A47G 9/0215; A47G 9/02; A47C 21/028

See application file for complete search history.

(56) References Cited

U.S. PATENT DOCUMENTS 2,998,817 A 9/1961 Armstrong
3,895,404 A * 7/1975 Wilson ..... A47G 9/02 5/482

(Continued)

FOREIGN PATENT DOCUMENTS

BE 647106 A 8/1964
CN 204146750 U 2/2015

(Continued)

OTHER PUBLICATIONS

Supplementary European Search Report in corresponding EP 17857748.2 issued May 20, 2020.

(Continued)

*Primary Examiner* — Myles A Throop

(74) *Attorney, Agent, or Firm* — Damien Calvet; Gowling WLG (Canada) LLP

(57) ABSTRACT

A bedding system, method and kit for the automation and ventilation of an existing duvet are disclosed. The system has an inflatable lining configured to be inserted and affixed into a cover together with the duvet, the inflatable lining comprising a network of pneumatic chambers defining a plurality of openings extending through the lining allowing air to circulate through the lining; and an air blower operatively connected to the inflatable lining for blowing air into the network of pneumatic chambers, so as in use, the inflatable lining is inflated to allow for the duvet and its cover to be straightened back into position after every use of the bed. The system can also include a sub-network for providing warm or cold air to control the temperature of the bedding. In contrast to traditional systems, the proposed invention is light weight and easily adaptable to current commercially available beds.

18 Claims, 12 Drawing Sheets

Related U.S. Application Data

(60) Provisional application No. 62/405,044, filed on Oct. 6, 2016.

(56) References Cited

U.S. PATENT DOCUMENTS

| | | | | |
|---|---|---|---|---|
| 4,441,222 | A | 4/1984 | Tascarella | |
| 5,265,293 | A * | 11/1993 | Spahn | A47C 27/081 5/724 |
| 5,405,370 | A | 4/1995 | Irani | |
| 5,675,855 | A | 10/1997 | Culp | |
| 5,749,109 | A | 5/1998 | Kappel | |
| 5,926,874 | A | 7/1999 | Browder | |
| 6,164,314 | A | 12/2000 | Saputo | |
| 6,734,398 | B1 | 5/2004 | Cecchi | |
| 7,996,936 | B2 | 8/2011 | Marquette | |
| 8,250,688 | B2 | 8/2012 | Alegria Mendez | |
| 8,528,133 | B2 | 9/2013 | Van Houtte | |
| D737,599 | S | 9/2015 | Aldridge | |
| 10,136,735 | B2 | 11/2018 | Ocegueda | |
| 11,564,512 | B2 * | 1/2023 | Lemieux | A47G 9/0207 |
| 2004/0133978 | A1 | 7/2004 | Fairchild et al. | |
| 2006/0073748 | A1 | 4/2006 | Boujon | |
| 2007/0000182 | A1 | 1/2007 | Boujon | |
| 2009/0083909 | A1 | 4/2009 | Amsler, Jr. | |
| 2010/0287701 | A1 | 11/2010 | Frias | |
| 2011/0115635 | A1 * | 5/2011 | Petrovski | A47C 31/008 340/584 |
| 2015/0074904 | A1 | 3/2015 | Aramli | |
| 2015/0223612 | A1 | 8/2015 | Alegria Mendez et al. | |
| 2015/0320588 | A1 | 11/2015 | Connor | |
| 2019/0049027 | A1 | 2/2019 | Bais | |

FOREIGN PATENT DOCUMENTS

| | | | |
|---|---|---|---|
| GB | 716746 | A | 10/1954 |
| WO | 2007060371 | A3 | 5/2005 |

OTHER PUBLICATIONS

Anonymous, Sabrina, "Pool Floats & Pool Rafts: a Buyer's Guide—IntheSwim Pool Blog", http://blog.intheswim.com.pool-floats-pool-rafts-a-buyers-guide/, Jun. 19, 2012.

IB373—International Preliminary Report on Patentability of PCT/CA2017/051199, published on Apr. 9, 2019.

ISA/210—International Search Report of PCT/CA2017/051199, published on Apr. 12, 2018.

* cited by examiner

SELF-MAKING BEDDING SYSTEM, METHOD AND KIT THEREOF

CROSS-REFERENCE TO RELATED APPLICATIONS

The present patent application is a continuation of U.S. patent application Ser. No. 16/340,279 filed on Apr. 8, 2019, which is a 371 national phase of international application PCT/CA2017/051199 filed on Jun. 10, 2017 which claims the benefits of priority of commonly assigned U.S. patent application Ser. No. 62/405,044 entitled "Self-making Bed Blanket with Temperature Control System" and filed at the U.S. patent and trademark office on Oct. 6, 2016, the content of which is incorporated herein by reference.

FIELD OF THE INVENTION

The present invention generally relates to a bedding system and method for the automation and ventilation of an existing duvet, comforter or blanket.

BACKGROUND OF THE INVENTION

Controllable bed systems have been manufactured for many years, such as automated systems incorporated into the bed frame that adjust to a user wanting to sit up in bed to watch television with their partner lying down. As the controllable comfort of a user in their home becomes more and more important with the advent of networked and automated systems in the home, new ways of keeping the home in order with added comfort features becomes interesting to consumers. Several traditional systems offer a single, independent solution as a heavy weight bed system that is not adaptable to a user's current bed and is to be purchased as a single, whole bed apparatus.

U.S. Pat. No. 3,895,404 (Wilson) describes tubular members that are deflated and are non-rigid that causes bedding to straighten out over the surface of the bed by releasing a charge of gas under pressure into the tubular members.

U.S. Pat. No. 4,441,222 A (Tascarella) describes an automatic bed maker, electrically-operated, with helical screw actions attached to the frame that smoothes bedding.

U.S. Pat. No. US 5,926,874 A (Browder) discloses an automatic bed maker using a the expansion of an inflatable bladder. However, the bladder cannot be used in combination with existing bedding and does not have air circulation built in.

U.S. Pat. No. 8,250,688 B2 (Mendez et al.), discloses a bedding straightening system attached to a base of an ordinary bed, including a blanket air distributor, bottom sheet side air distributors, connectors, bottom sheet, top blanket and sheet.

U.S. Pat. No. 8,528,133 B2 (Van Houte) describes a bed making system with a U-shaped braced defined by two parallel arm and a connecting bar with a topping mattress and a base mattress.

International patent application no. WO 2007/060371 A3 (Clodic et al.) describes the distribution of hot and cold air throughout the whole surface of the blanket forcing the need for a lot of air distributed in places where the user doesn't feel it. It also does not help in the making of the bed nor helps humidity evacuation since it covers the whole area without any openings.

U.S. patent application Ser. no. US 2015/0223612 A1 (Mendez et al.) discloses an independent equipment for bedding straightening intended for automatically unfolding and straightening bed clothing by means of compressed air inflatable sleeves associated with bed clothes, such that when the air is introduced under pressure into such inflatable sleeves, these are unfolded and straightened pulling bedding along which become also straightened.

The main shortcomings of the prior art are that they do not offer a light weight system to provide several comfort and organizational features in one that are controllable by a user and that may be adapted to any currently commercially available bed apparatus.

The shortcomings are generally mitigated by the fact that the bedding system proposed herewith does not require any permanent installation or new hardware other than the device itself and allows the users to make their existing bedding in an automated and ventilated, way, furthermore controlling temperature and air circulation for different parts of the bedding to be accustomed to one or more users.

SUMMARY OF THE INVENTION

A bedding system is proposed that comprises comfort, convenience and well-being features in one light weight apparatus to keep existing bedding and bed made (duvet/comforter, duvet cover, bed sheets, bed) and in dry, ventilated order, by automation and ready for use by one or two users that may want to be cooled and heated according to their own liking when they may be simultaneously settled in the bed.

According to a first aspect, the invention is directed to a bedding system for the automation and ventilation of an existing duvet, the bedding system comprising:

an inflatable lining configured to be inserted and affixed into a cover of a duvet together with the duvet, the inflatable lining comprising a network of pneumatic chambers defining a plurality of openings extending through the lining allowing air to circulate through the lining; and an air blower operatively connected to the inflatable lining for blowing air into the network of pneumatic chambers, so as in use, the inflatable lining is inflated to allow for the duvet and its cover to be straightened back into position after every use of the duvet.

According to a preferred embodiment, the network of pneumatic chambers defines a grid shaped inflatable lining with squared or circular openings arranged to form column and rows.

According to a preferred embodiment, the inflatable lining comprises an upper and lower layers affixed together to form the plurality of pneumatic chambers, and a valve connected to the inflatable lining, the valve being configured to receive air from the air blower via a connecting tube for inflating the inflatable lining, and to let the air to escape the inflatable lining when the air blower stops for deflating the inflatable lining when the duvet and its cover are back into position. The inflatable lining may define a second network of pneumatic chambers configured to circulate and distribute hot or cold air towards a user laid in a bed under the duvet so as to regulate the temperature of the duvet. The second network may comprise more than one separate sub-networks, for instance two or four, for distributing air with different temperatures in specific regions of the bed. The lower layer of the inflating lining may comprise a plurality of holes in connection with the second network for distributing the temperature-controlled air.

According to a preferred embodiment, the upper and lower layers are connected together by a lateral vertical wall made of an extensible material, so as when the lining is inflated, the lateral wall extends to straighten the lining back into position, and when the air blower stops injecting air into the lining, the extensible lateral wall creates a force that, in connection with the valve, allows the lining to deflate to provide a natural look to the duvet back into position.

According to a preferred embodiment, the inflatable lining comprises non-permanent attaching elements for attaching the inflatable lining to the duvet cover and/or the duvet.

According to a preferred embodiment, the air blower is configured to be activated for a given amount of time to send air into said network of pneumatic chambers.

According to a preferred embodiment, the air blower is controlled via an application connected over a network to the apparatus or by a hard wired controller on the apparatus.

According to a preferred embodiment, the air blower is controlled by either Bluetooth or WIFI via an application installed on a computer, Smartphone or tablet.

According to a second aspect, the invention is directed to a method for the making of a bed using a bedding system for the automation and ventilation of an existing duvet, the method comprising the steps of:

a) providing an inflatable lining configured to be inserted and affixed into a cover of a duvet together with the duvet, the inflatable lining comprising a network of pneumatic chambers defining a plurality of openings extending through the lining allowing air to circulate through the lining;

b) inserting the inflatable lining into the cover together with the duvet;

c) inflating the inflatable lining by turning on an air blower operatively connected to the inflatable lining for a given amount of time for blowing air into the network of pneumatic chambers; the duvet and its cover being then straightened back into position.

According to a preferred embodiment, the method further comprises before step b) the step of attaching the inflatable lining to the duvet.

According to a preferred embodiment, the method further comprises after step c) the step of deflating the inflated lining by turning off the air blower once the inflatable lining, the duvet and the cover are back into position.

According to a preferred embodiment, the method further comprises the step of regulating the temperature of the duvet by selecting a temperature of the air sent into a second network of pneumatic chambers configured to circulate and distribute hot or cold air in specific regions of the lining.

According to a preferred embodiment, the method further comprises the step of controlling the air blower via an application connected over a network to the apparatus or by a hard wired controller on the apparatus.

According to a preferred embodiment, the method further comprises the step of controlling the air blower by either Bluetooth or WIFI via an application installed on a computer, Smartphone or tablet.

According to a third aspect, the invention is directed to a kit for the automation and ventilation of an existing duvet, the kit comprising:

an inflatable lining configured to be inserted and affixed into a cover of a duvet together with the duvet, the inflatable lining comprising a network of pneumatic chambers defining a plurality of openings extending through the lining allowing air to circulate through the lining; and an air blower operatively connected to the inflatable lining for blowing air for a given amount of time into the network of pneumatic chambers, so as in use, the inflatable lining is inflated to allow for the duvet and its cover to be straightened back into position after every use of the bed.

According to a preferred embodiment, the kit further comprises a manual for the installation and use of the kit and bedding system.

This "grid shaped inflatable air lining" comprises a network of pneumatic chambers allowing for the comforter and sheets to be straightened back into position after every use of the bed.

The device may also include a separate network of pneumatic chambers allowing the distribution of hot and cold air in specific regions of the bed (through the duvet/comforter). For instance, two persons in the same bed may have different air circulation temperatures sent to each of them. They can each also choose which section of the body they want to heat or cool.(ex: upper body, lower body).

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above description and other aspects, features and advantages of the invention will become more readily apparent from the following description, reference being made to the accompanying drawings in which.

DETAILED DESCRIPTION OF SOME PREFERRED EMBODIMENTS

A novel light weight, smart, universal self-making bedding system and method are described herein. Although the invention is described in terms of specific illustrative embodiments, it is to be understood that the embodiments described herein are by way of example only and that the scope of the invention is not intended to be limited thereby.

Figure 1:
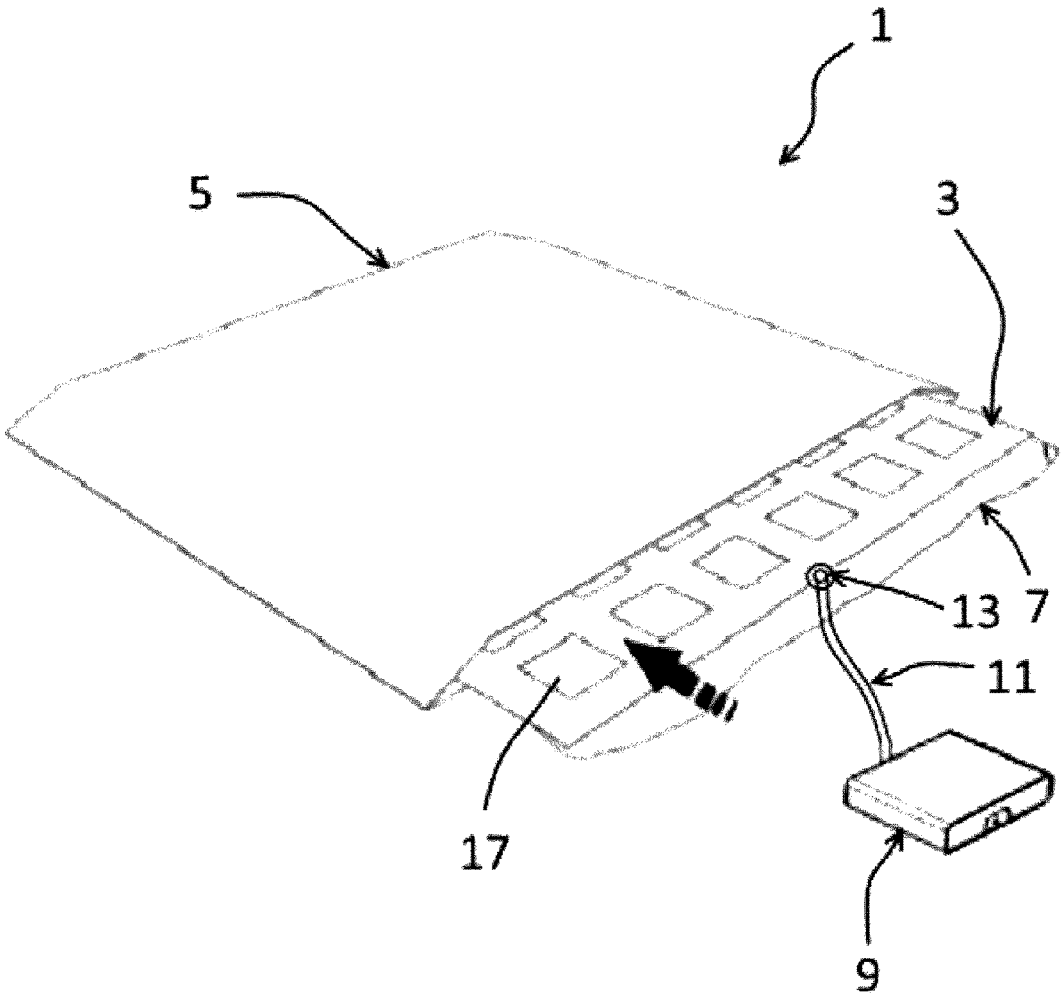
FIG. 1 illustrates a bedding system in accordance with a preferred embodiment of the invention.
Figure 2:
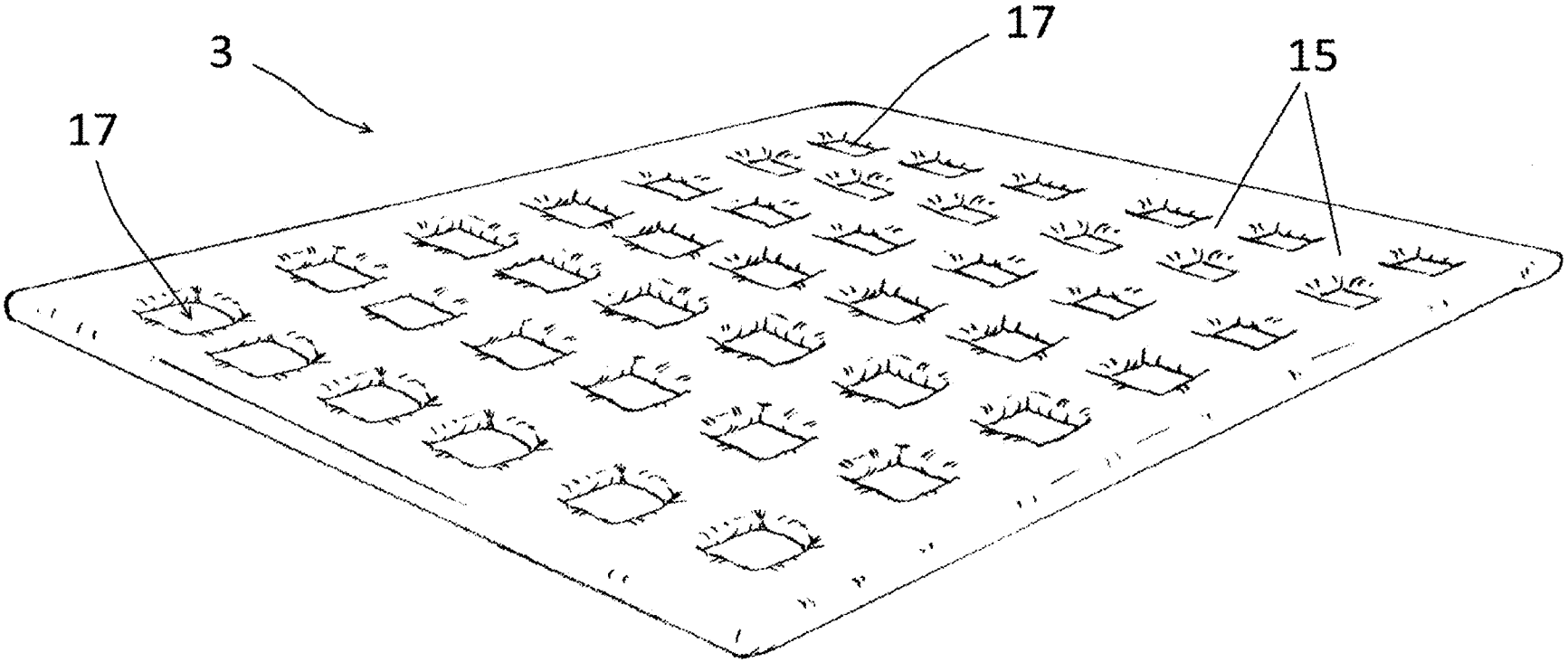
FIG. 2 illustrates an inflatable lining of the bedding system in accordance with a first preferred embodiment of the invention.

A bedding system 1 for the automation and ventilation of an existing duvet is illustrated on FIG. 1. The bedding system comprises an inflatable lining 3 configured to be inserted and affixed into a cover 5 of a duvet 7 together with the duvet. The bedding system also comprises an air blower 9 operatively connected to the inflatable lining 3 for blowing air into the inflatable lining. For instance, an air delivery connecting tube or conduit 11 connects the blower 9 to the lining 3 via a valve 13 located on an edge of the lining 3.

As illustrated on FIGS. 2 to 5, the inflatable lining 3 comprises a network of pneumatic chambers 15, defining a plurality of openings 17 extending through the lining allowing the ambient air to circulate through the lining, forming as such a "grid shaped" inflatable lining 3. As better detailed herein after, the inflatable lining 3 is inflated to allow for the duvet and its cover to be straightened back into position after every use of the bed.

The cover 5 of the duvet 3 embeds the "grid shaped" inflatable lining 3. The lining 3, more visible on FIGS. 2 and 3, may be placed over a duvet and/or under the duvet cover after regular use of the bed. The inflatable lining may also be used under the duvet, in the duvet cover, for improved air circulation.

According to a preferred embodiment, the network of pneumatic chambers defines a grid shaped inflatable lining with squared openings (FIGS. 1 and 2) or circular openings (FIGS. 3 and 4) arranged to form column 19 and rows 21.

Figure 3:
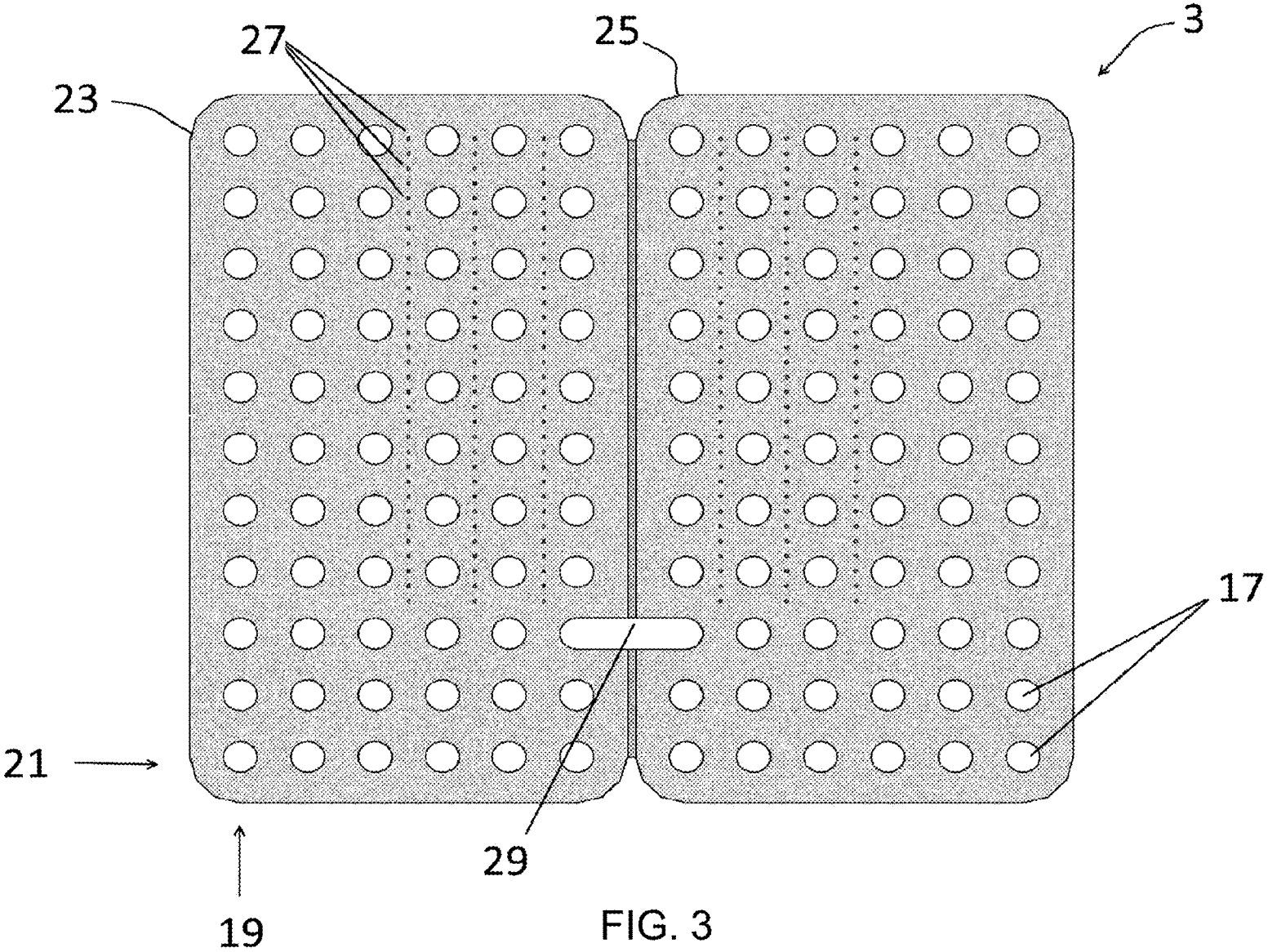
FIG. 3 is a plan view of an inflatable lining of the bedding system in accordance with a second preferred embodiment of the invention.
Figure 4:
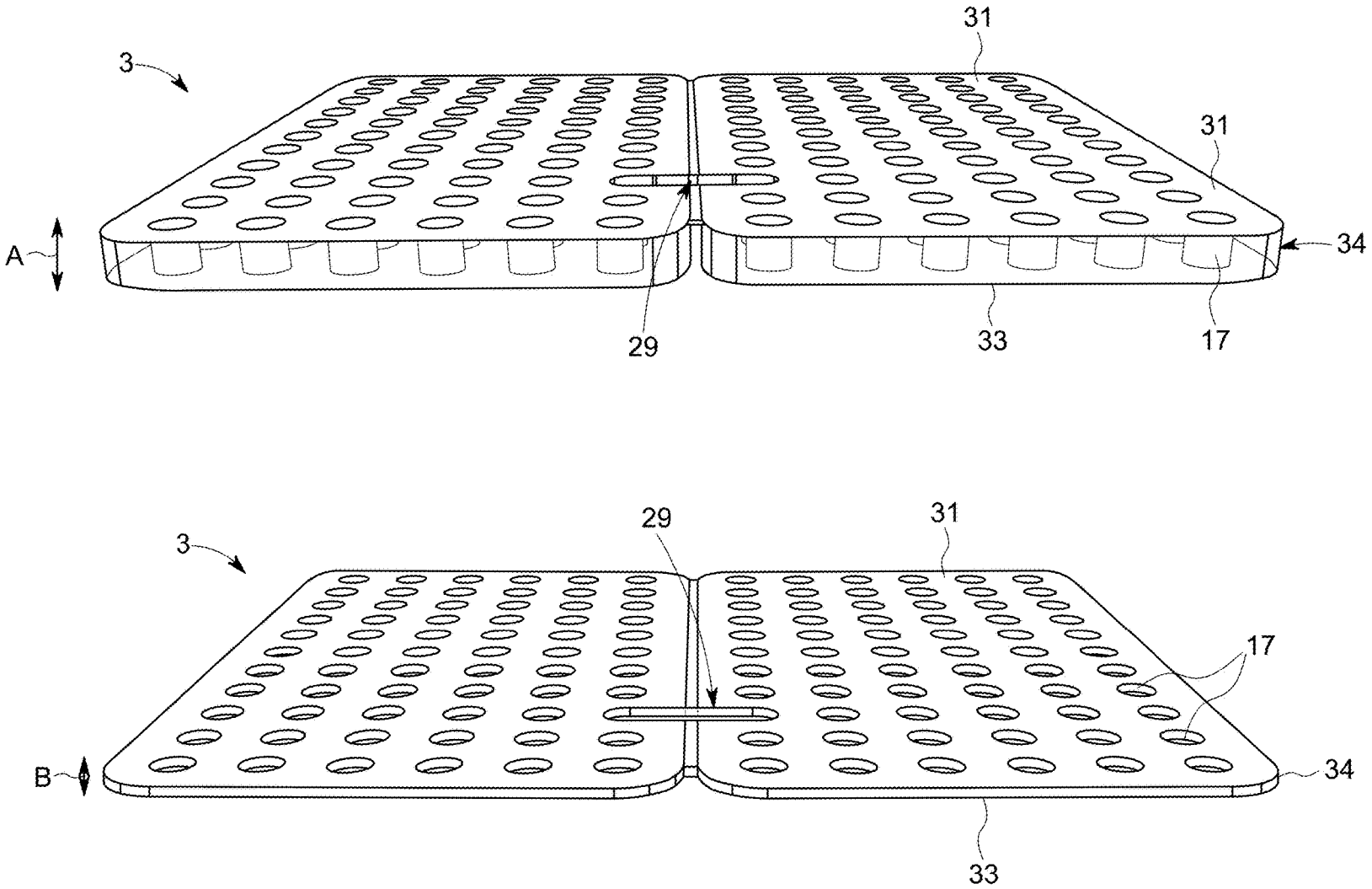
FIG. 4 is a perspective view of the bedding system illustrated on FIG. 3, with: (A) a inflated configuration, and (B) in a deflated configuration.

As illustrated on FIGS. 3 and 4, the lining 3 may comprises to longitudinal sections 23, 25 corresponding to the two sides of the bed when the bed is large enough to accommodate two persons. It is understood that the size of the lining is adapted to the size of the duvet and duvet cover that are adapted themselves to the size of the bed. The lining 3 may comprises a plurality of small holes 27 for distributing temperature controlled air. The lining may also comprise a large opening 29 generally used for connecting the air blower (or control box) 9 to the lining.

Figure 6:
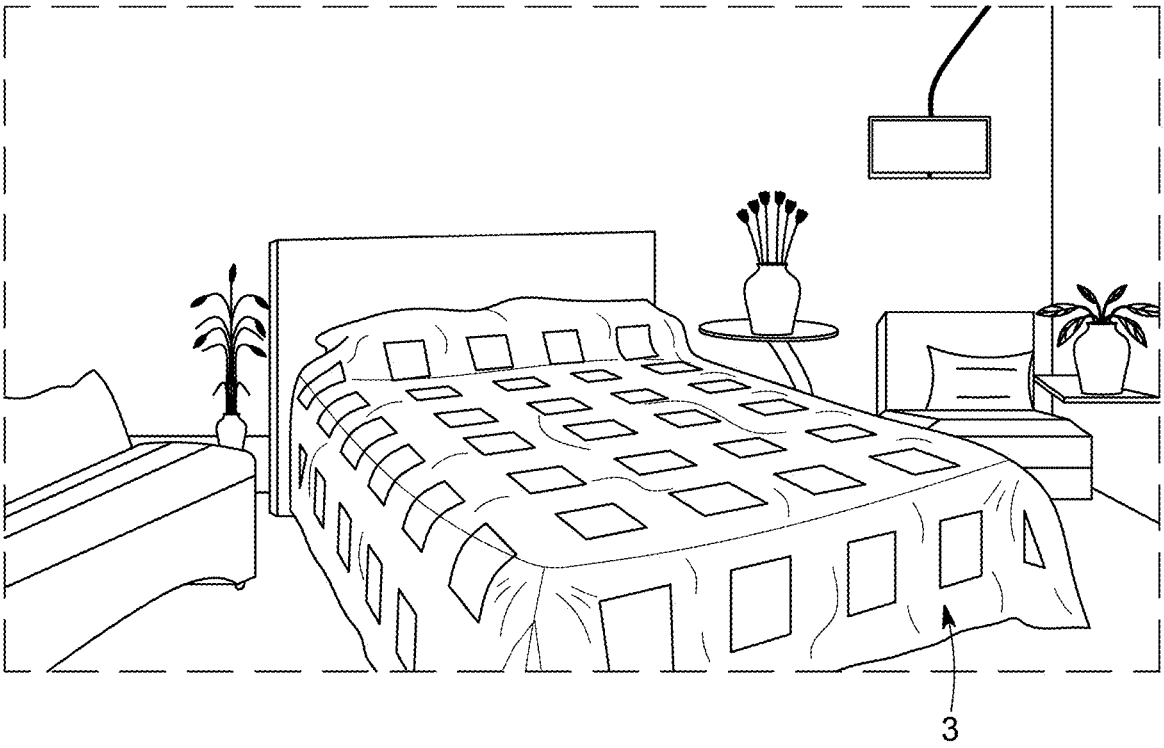
FIG. 6 is a picture showing the inflatable lining in accordance with a preferred embodiment of the invention, installed on a bed.

FIG. 4, top view A, illustrated the lining of FIG. 3 in an inflated configuration, whereas FIG. 4, bottom view B, illustrates the same lining in a deflated configuration. The inflatable lining comprises an upper and lower layers 31, 33 affixed together to form the plurality of pneumatic chambers. The periphery or edges of the upper and lower layers may be connected by a lateral wall 34, preferably made of an extensible material whereas the upper and lower layers are preferable made of a non-extensible fabric. When the lining is inflated (FIG. 4A), the lateral wall 34 extends to straighten the lining 3. When the air blower stops to inject air into the lining, the extensible lateral wall 34 creates a force that, in connection with an outlet, allows the air to exit the lining without the use of a pump. The lining back into position deflates naturally to provide a natural/normal look to the duvet back into position (see for instance the lining illustrated on FIG. 6).

The valve 13, visible on FIG. 1, is configured to receive air from the air blower 9 via the connecting tube 11 for inflating the inflatable lining 3, and also to let the air to escape the inflatable lining when the air blower stops for deflating the inflatable lining when the duvet and its cover are back into position.

Figure 5:
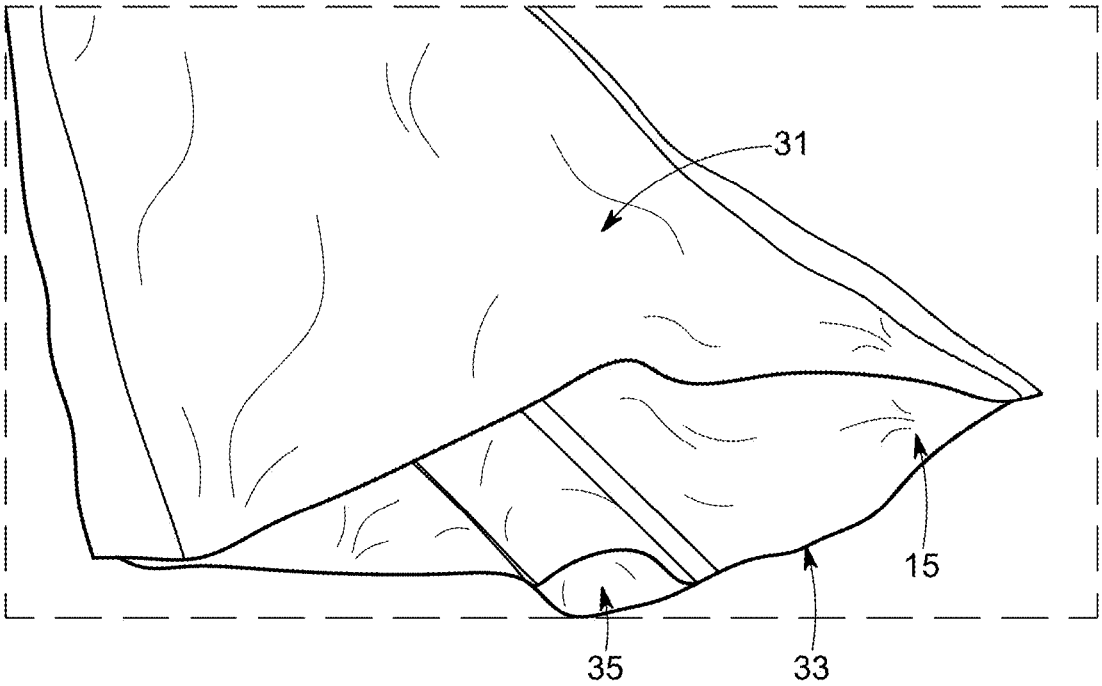
FIG. 5 is a partial view of the inflatable lining detailing the first and second network of pneumatic chambers, in accordance with a preferred embodiment of the invention.

As illustrated on FIG. 5, the upper or lower layer 31, 33 of the inflatable lining 3 form the pneumatic chamber 15. The lining 3 may define a second network of pneumatic chambers 35 configured to circulate and distribute hot or cold air in specific regions of the lining, for instance using the small holes 27 visible on FIG. 3, so as to regulate the temperature of the duvet.

Figure 11A:
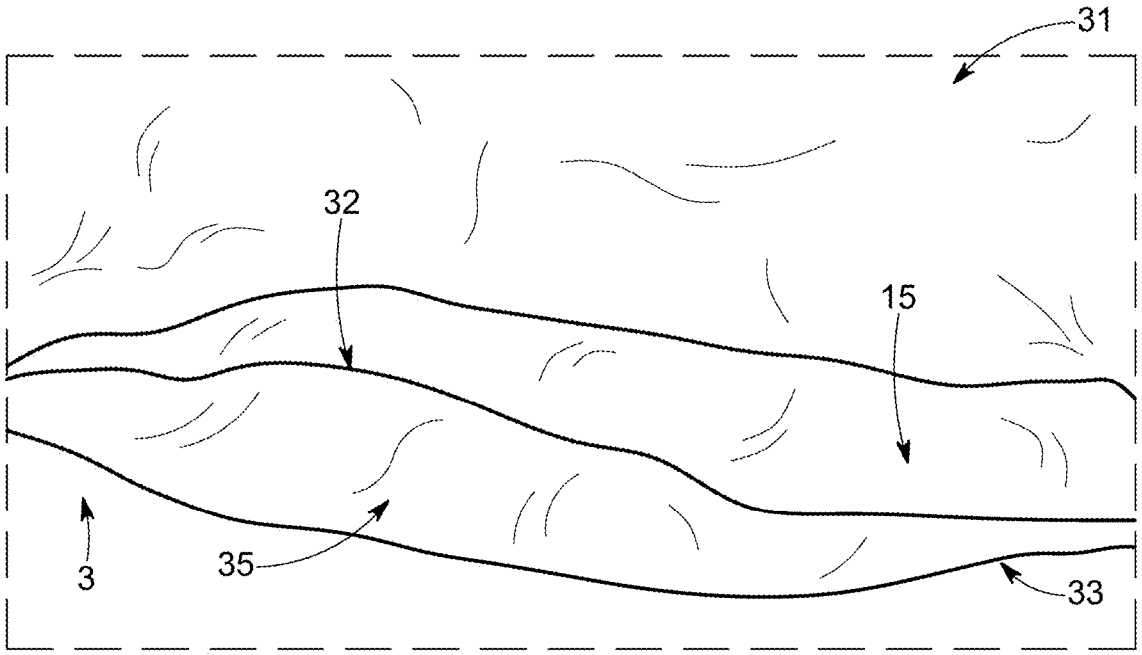
FIGS. 11A-11B are partial views of the inflatable lining detailing the first and second network of pneumatic chambers, in accordance with a second preferred embodiment of the invention.
Figure 11B:
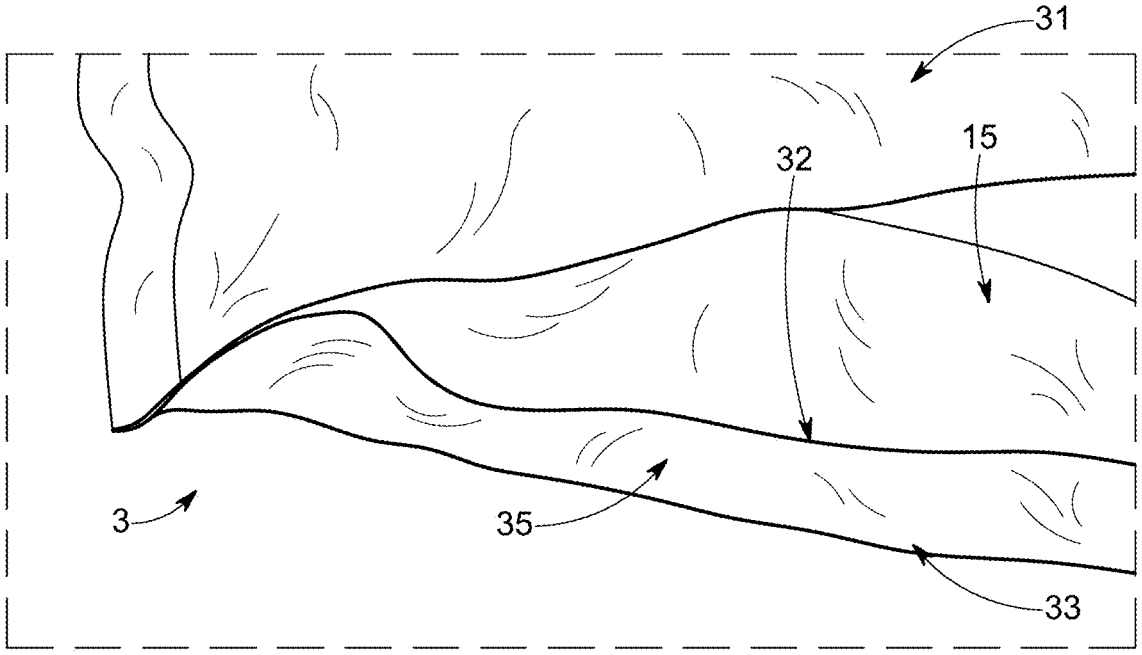

FIGS. 11A and 11B illustrate an alternative configuration than the one illustrated in FIG. 5, wherein the inflatable lining 3 comprises the upper and lower layers 31,33, and an intermediate wall 32 sandwiched between the two layers. The upper layer 31 and the wall 32 form the first network 15 whereas the wall 32 and the lower layer 33 form the second network 35 for distributing the temperature controlled air. The plurality of distributing holes 27 will be located through the lower layer 33 to provide the air to the user laid in the bed under the duvet.

It has to be understood that when the bedding system comprises the second network 35 for distributing warm or cold air, the inflatable lining should be placed under the duvet 7 into the cover 5 to allow distributing the temperature controlled air directly to the user laid in the bed under the duvet thanks to the holes 27 of the second network 35.

Figure 7:
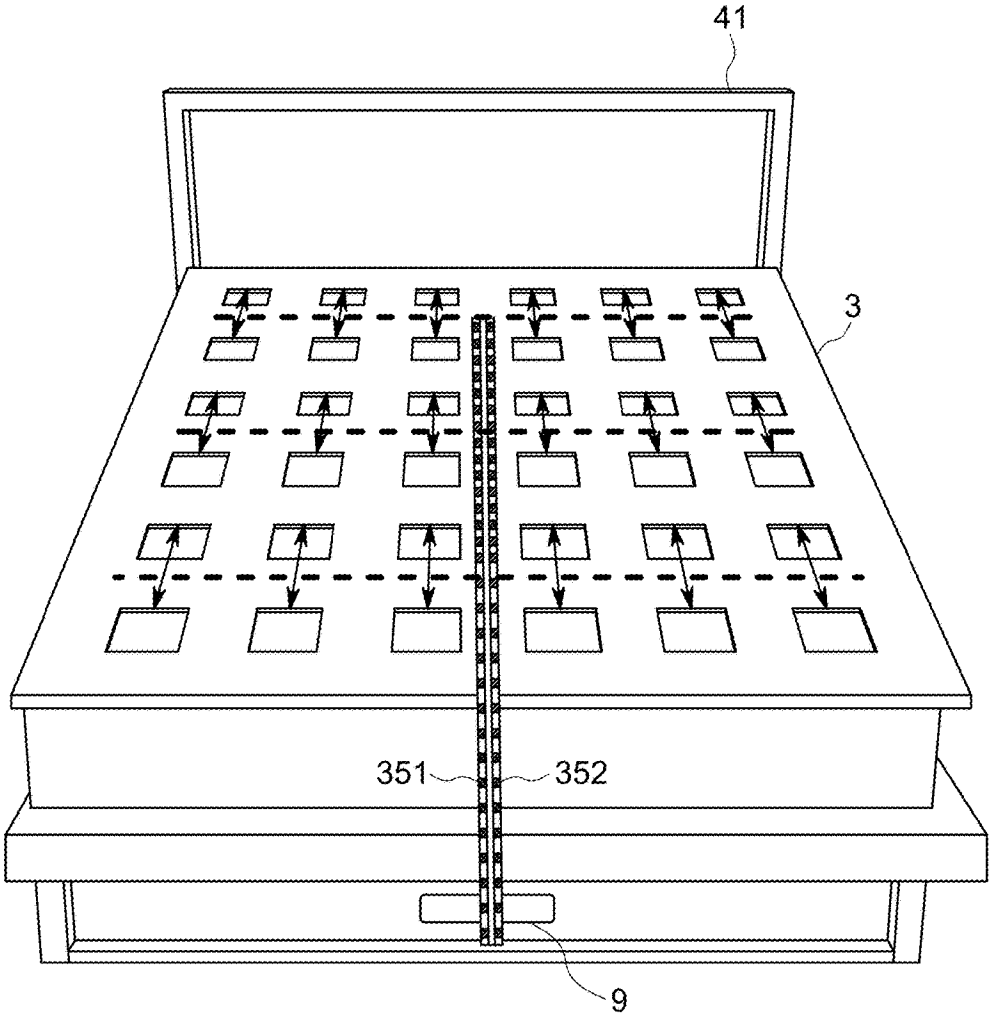
FIG. 7 is a schematic view of the inflatable lining with two sub-networks for controlling the temperature in accordance with a preferred embodiment of the invention.
Figure 8:
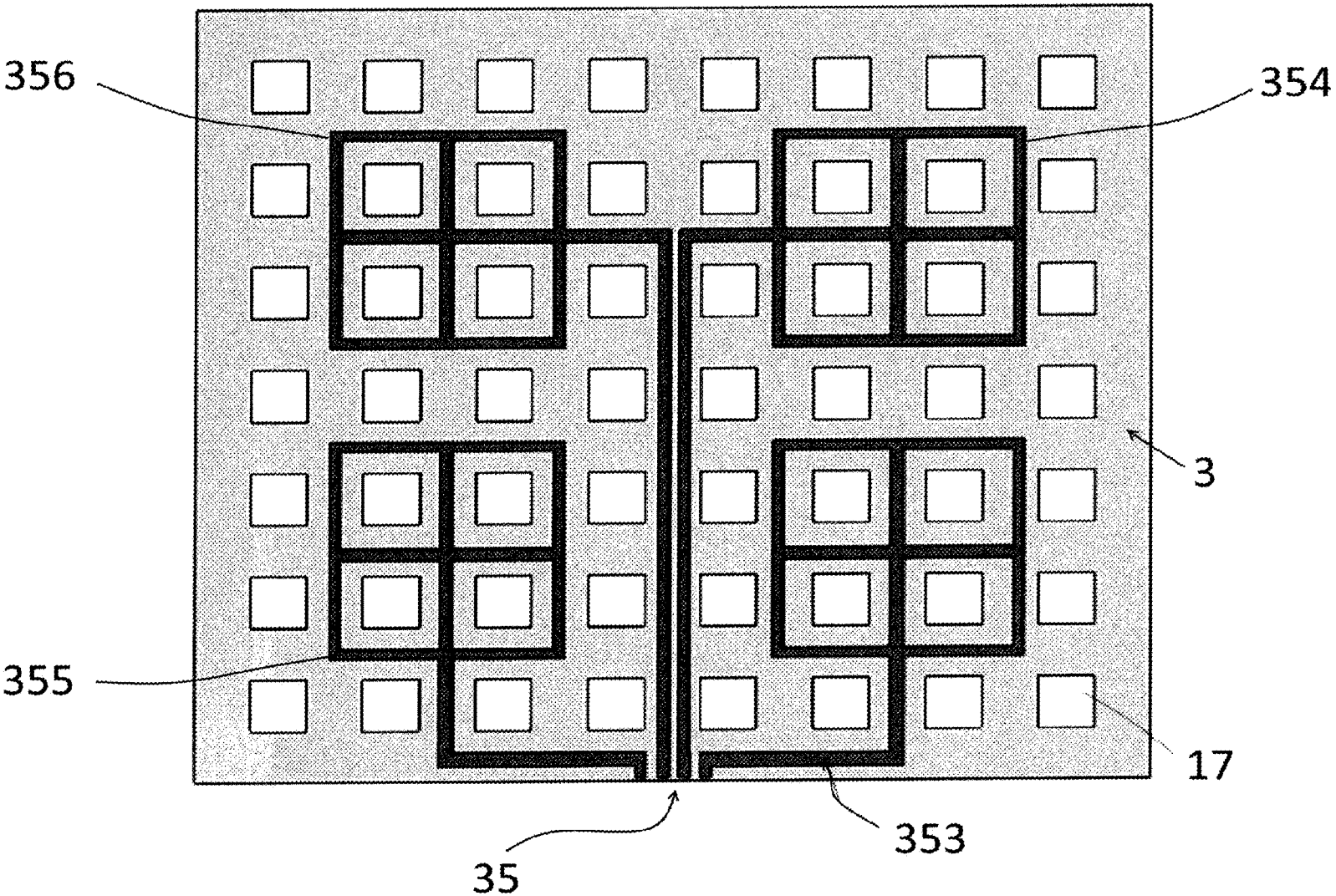
FIG. 8 is a schematic view of the inflatable lining with four sub-networks for controlling the temperature in accordance with a preferred embodiment of the invention.

As illustrated on FIGS. 7 and 8, this second network 35 may further define at least two separate sub-networks 351, 352 for distributing air with different temperatures in specific regions of the bed. Two different sub-networks are illustrated on FIG. 7 (Right and Left side of the bed) and four sub-networks 353, 354, 355, 356 are illustrated on FIG. 8. In this last case, the temperature may be controlled on each side of the bed, but also on the top and bottom sections of the bed allowing for instance to have a different temperature of the bed for the upper body and the lower body (feet).

Figure 9:
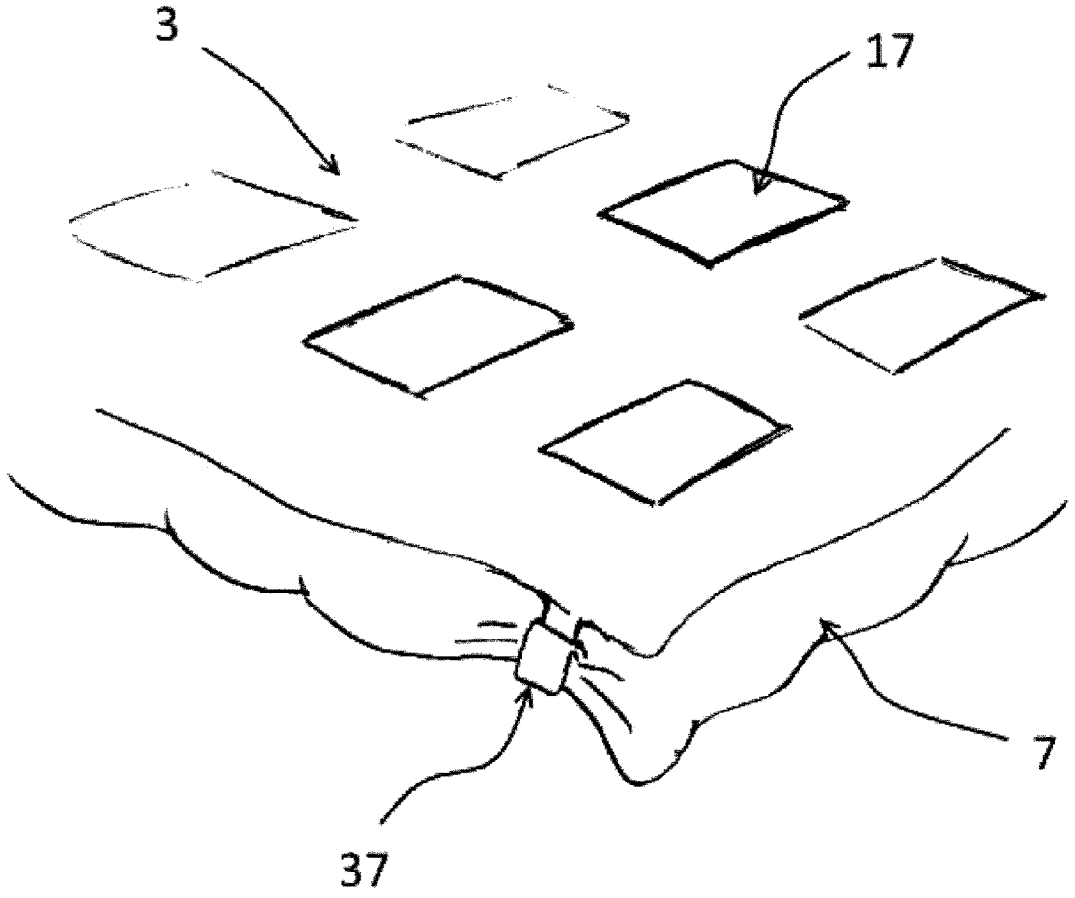
FIG. 9 is a partial view of the inflatable lining showing details of an attachment system in accordance with a preferred embodiment of the invention.

As illustrated on FIG. 9, the inflatable lining 3 may comprise non-permanent attaching elements 37 for attaching the inflatable lining to the duvet cover and/or the duvet 7. For instance, the non-permanent attaching elements can be clips, zippers, Velcro® bands, or a top ring to be clipped into a bottom knob. It is understood that any sorts of non-permanent attaching elements known in the art can be used.

The air blower 9, also named control box, is illustrated on FIG. 1. It is configured to be activated for a given amount of time to send air into said network of pneumatic chambers. The same blower is configured to send the temperature controlled air to the lining via the second network 35 mentioned before. The air blower/control box 9 may be controlled via an application connected over a network to the apparatus or by a hard wired controller on the apparatus. More preferably, the air blower/control box 9 is controlled by either Bluetooth or WIFI via an application installed on a computer, Smartphone or tablet.

The material of the for the making of the inflatable lining 3 may be comprised of Nylon®, Cuben fiber, Kevlar® fiber, cotton, polyester or any traditional bedding fabric/material known in the art and be eventually coated with silicon, polyurethane, Silpoly or other coatings known in the Art.

FIGS. 10A-10E illustrates the steps of the method for the making of a bed using a bedding system according to the invention for the automation and ventilation of an existing duvet.

Figure 10A:
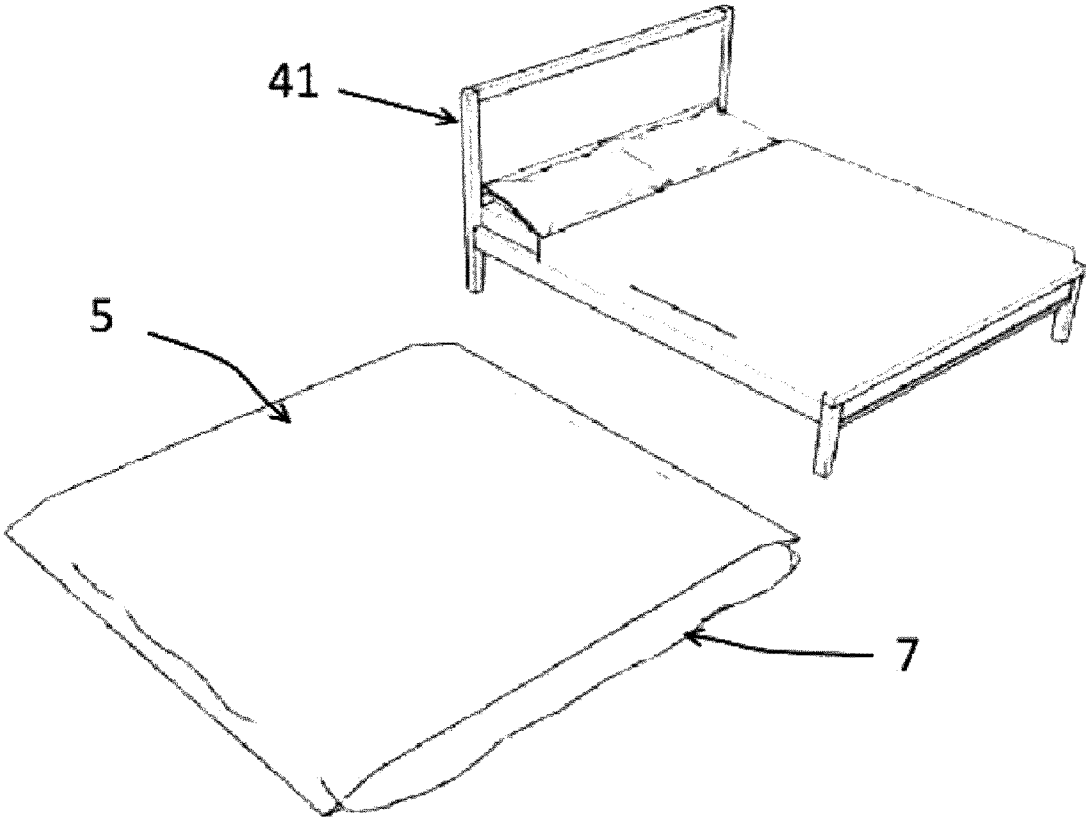
FIGS. 10A-10E illustrate the steps of the method for the making of a bed using a bedding system according to a preferred embodiment of the invention.

As illustrated on FIG. 10A, the user can first remove the duvet 7 and its cover 5 from the bed 41.

Figure 10B:
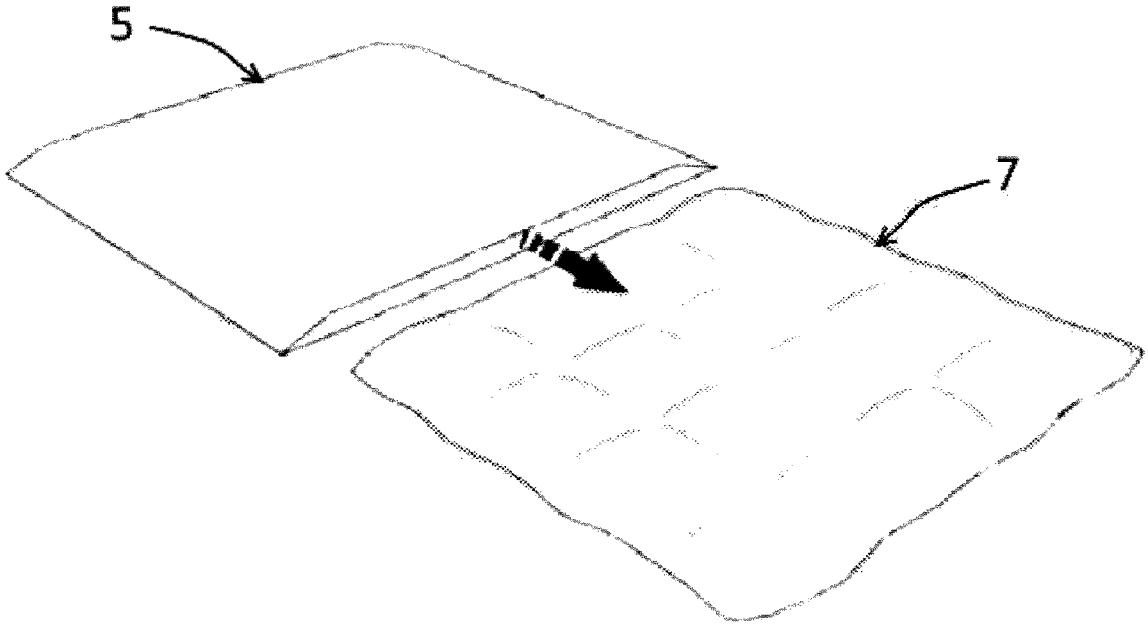

Then, as illustrated on FIG. 10B, the user can remove the duvet 7 from the cover 5.

Figure 10C:
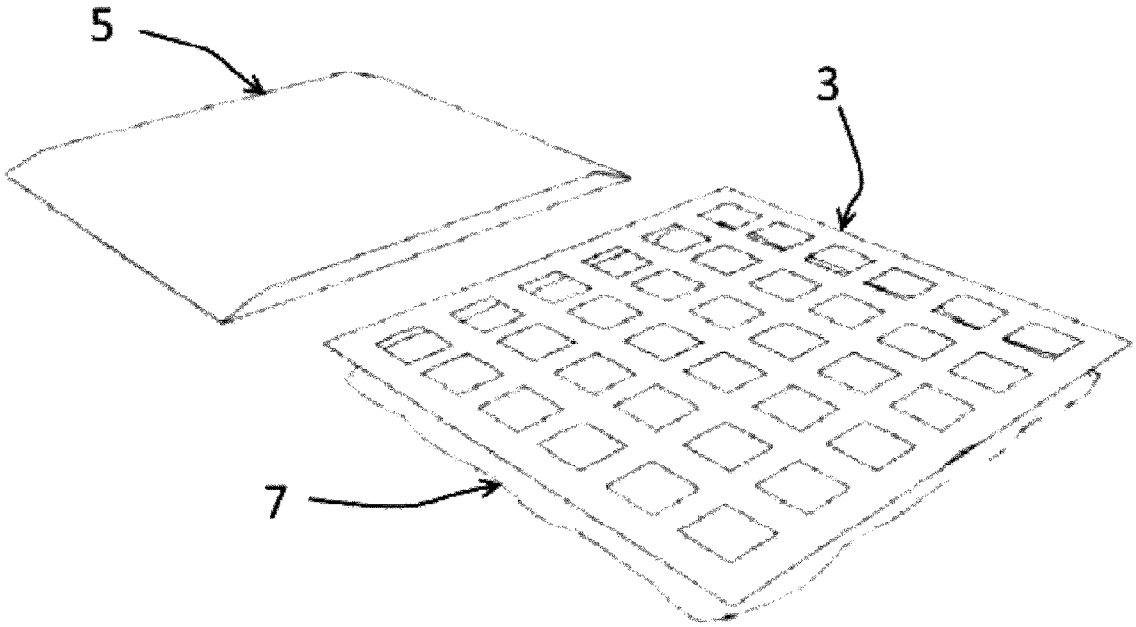
Figure 10D:
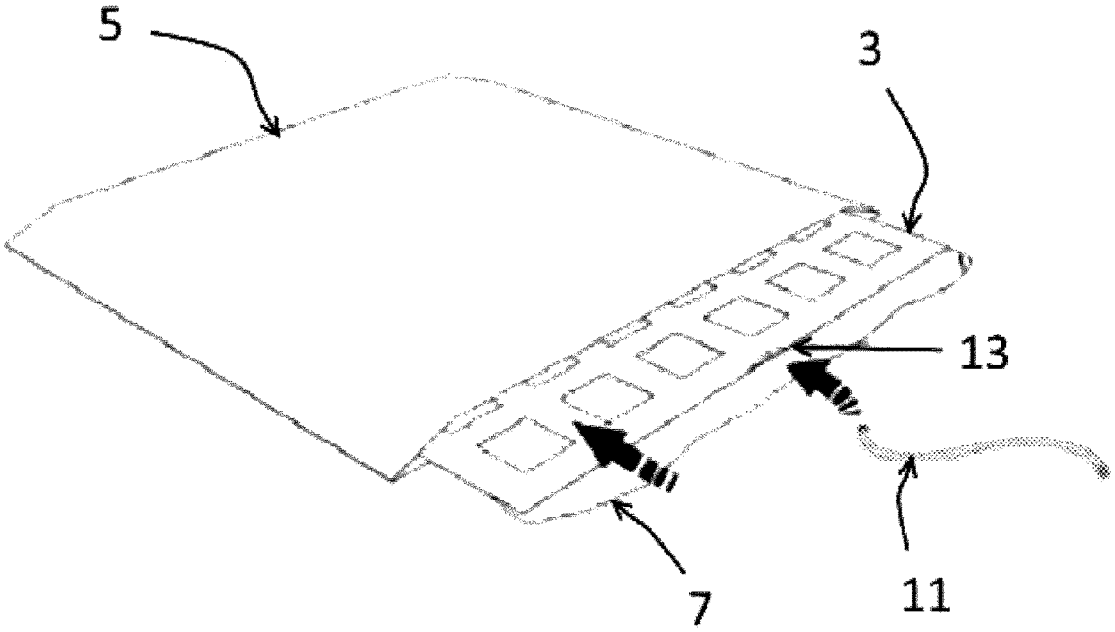

Then, as illustrated on FIG. 10C, the user can provide an inflatable lining configured to be almost identical in size with the duvet and to fix the lining 3 to the duvet, preferably before inserting the lining and the duvet into the cover, as illustrated on FIG. 10D.

Figure 10E:
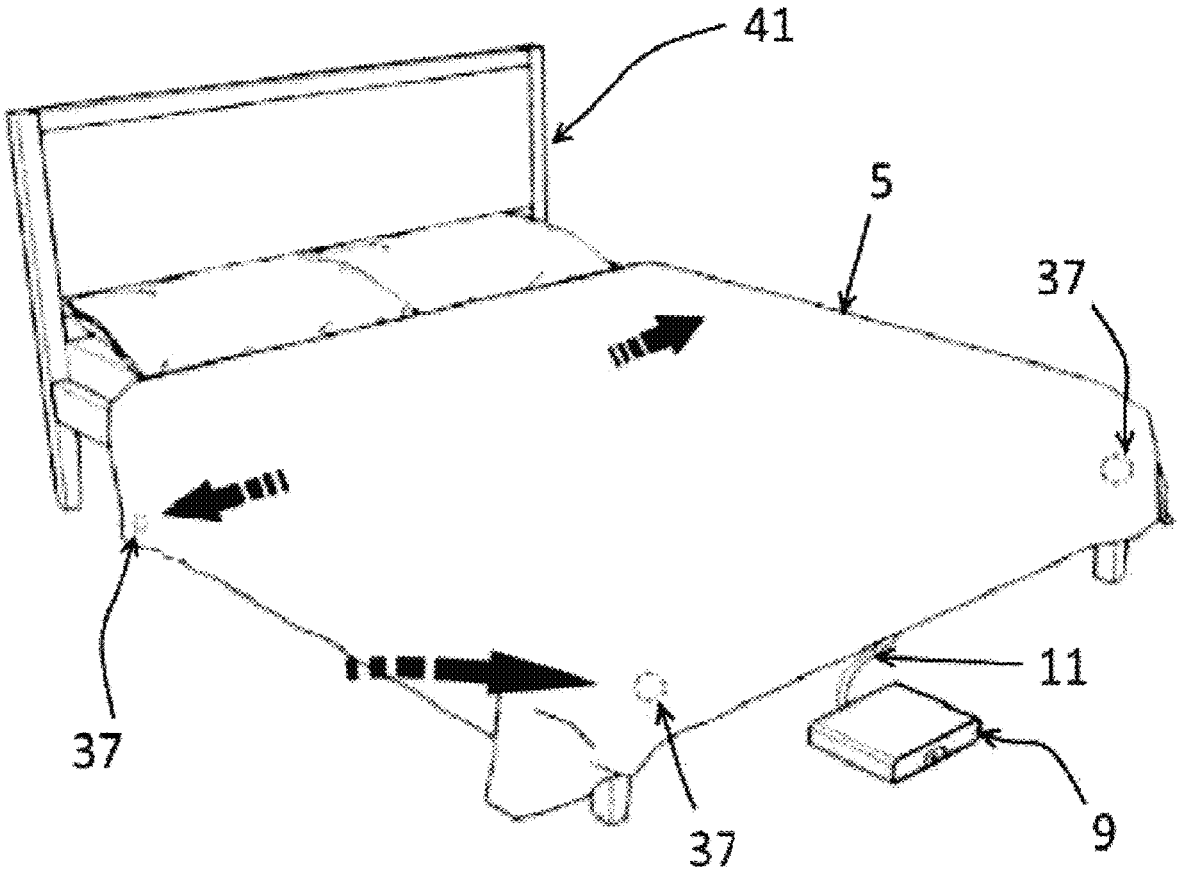

Then, as illustrated on FIG. 10E, once the duvet, the cover and the inflatable lining are disposed on the bed, the lining can be connected to the air blower 9 via the air tube before inflating the inflatable lining by turning on the air blower 9. The duvet and its cover can then straight back into position (illustrated by the big black arrows on FIG. 10E).

The FIG. 10E also shows positions of several non-permanent attaching elements 37 for attaching the inflatable lining to the duvet cover and/or the duvet 7.

The herein described invention was created to allow its users to have their bed made without any effort. It is also intended to give users a way to cool or warm their bed without having to cool or warm the whole room or house. The integration of elements are such that users' existing bedding and beds (duvet/comforter, duvet cover, bed sheets, blankets, etc) are made and in ventilated order, ready for use by one or two users that may want to be cooled and heated according to their own liking when they are simultaneously settled in the bed.

This invention will be most useful for those who desire having a made bed every day without having to go through the traditional steps of making the bed.

This invention will be useful to anyone wishing to sleep in a colder/warmer bed without having to cool/warm the whole room/house.

This invention will be useful for those living with a handicap or suffering from any form of disability that could render bed making difficult.

This invention will help people living with temperature/humidity related illnesses by providing the right temperature adjustment and by lowering the humidity level of the bed.

The addition of a "grid shaped inflatable air lining" that utilises a network of pneumatic chambers allows making any bed a self-making bed. By adding a second network of pneumatic chambers, the self-making bed can also be a ventilated (warmed and cooled) bed.

The bedding system is attached to a reversed pump/air blower which can be activated for a specific amount of time to send the air into said network of pneumatic chambers. However, once the bed is made, the air in the network of pneumatic chambers may be released atmospherically by an outlet.

The device is attached to the duvet/comforter with the use of a non-permanent attach system, making the device easily removable allowing the cleaning of the duvet/comforter and duvet cover.

The apparatus may also include a non-permanent attach system to attach the bed sheets to the duvet/comforter, making the bed sheets follow the motion of the bedding system when making the bed resulting in the device making the bed as a whole with the duvet/comforter and bed sheet.

Furthermore, the inflatable lining 3 with its network of pneumatic chambers that make the bed, is separated or independent from the second network of ventilation conduits that not only allow for air ventilation, but also provide hot and cold air for heating and cooling which is controlled by the control box. Air pressure and air flow rates may therefore be different in the two separate networks.

The openings among the network of pneumatic chambers and the network of ventilation conduits allows for the circulation of hot or cold air, pressurized or not, thereby providing for the natural dissipation of temperature gradients which promotes natural humidity release.

In addition to this, the controllable features of the system are controllable by an application connected over a network to the apparatus or by a hard wired controller on the apparatus. The system may be advantageously controlled by either Bluetooth or WIFI via an application, RF or IF using a remote control or by a hard wire controller. Other known systems of control can be used.

In contrast to traditional systems, the proposed invention is light weight and easily adaptable to current commercially available beds.

The bedding system disclosed herewith can be sold as a kit comprising the different elements as defined herein: the inflatable lining (with different sizes eventually), the air blower/control box, the air tubing, and eventually a manual of installation and use.

While the illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. A bedding system for the automation and ventilation of an existing duvet, the bedding system comprising:

an inflatable lining configured to be inserted and affixed into a cover of a duvet together with the duvet, the inflatable lining comprising:

an upper layer and a lower layer affixed together along a periphery of the upper and lower layers;

a plurality of squared or circular openings arranged to form column and rows of said squared or circular openings through the upper and lower layers, an edge of each of said squared or circular openings being affixed together so as the inflatable lining comprises a first network of pneumatic chambers, the plurality of squared or circular openings extending through the inflatable lining in order to allow ambient air to circulate through the inflatable lining; and a middle longitudinal layer located between the upper and lower layers, the middle longitudinal layer having its longitudinal edges affixed to a portion of the lower layer of the inflatable lining in order to form a second network of pneumatic chambers configured to circulate and distribute hot or cold air towards a user laid in a bed under the lower layer so as to regulate the temperature of the duvet; and an air blower configured to be operatively connected to the first network of pneumatic chambers of the inflatable lining for blowing air into the first network of pneumatic chambers, so as in use, the first network of pneumatic chambers of the inflatable lining is inflated to allow for the duvet and its cover to be straightened back into position after every use of the duvet, the air blower being further configured to be operatively connected to the second network of pneumatic chambers to circulate and distribute the hot or cold air therein.

2. The bedding system of claim 1, wherein the inflatable lining further comprises:

a valve configured to receive air from the air blower via a connecting tube and fluidly connected to the first network of pneumatic chambers of the inflatable lining for inflating the first network of pneumatic chambers of the inflatable lining, and to let the air to escape the first network of pneumatic chambers of the inflatable lining when the air blower stops for deflating the first network of pneumatic chambers of the inflatable lining when the duvet and its cover are back into position.

3. The bedding system of claim 1, wherein the second network of pneumatic chambers defines comprises at least two separate sub-networks of pneumatic chambers for distributing air with different temperatures in specific regions of the bed.

4. The bedding system of claim 1, wherein the portion of the lower layer of the inflating lining affixed to the middle longitudinal layer comprise a plurality of holes in connection with the second network for distributing the temperature controlled air towards the user.

5. The bedding system of claim 1, wherein the upper and lower layers are affixed together along the periphery thereof via a lateral vertical wall made of an extensible material, so as when the first network of pneumatic chambers of the inflatable lining is inflated, the lateral wall extends to straighten the inflatable lining back into position, and when the air blower stops injecting air into the first network of pneumatic chambers of the inflatable lining, the extensible lateral wall creates a force that, in connection with the valve, allows the inflatable lining to deflate to provide a natural look to the duvet back into position.

6. The bedding system of claim 1, wherein the inflatable lining comprises non-permanent attaching elements for attaching the inflatable lining to the duvet cover or the duvet.

7. The bedding system of claim 1, wherein the air blower is configured to be activated for a given amount of time to send air into said first network of pneumatic chambers.

8. The bedding system of claim 1, wherein the air blower is controlled via an application connected over a network to the apparatus or by a hard wired controller on the apparatus.

9. The bedding system of claim 1, wherein the air blower is controlled by either Bluetooth or WIFI via an application installed on a computer, Smartphone or tablet.

10. A bedding system for the automation and ventilation of an existing duvet, the bedding system comprising:

an inflatable lining configured to be inserted and affixed into a cover of a duvet together with the duvet, the inflatable lining comprising:

an upper layer and a lower layer affixed together along a periphery of the upper and lower layers;

a plurality of squared or circular openings arranged to form column and rows of said squared or circular openings through the upper and lower layers, an edge of each of said squared or circular openings being affixed together so as the inflatable lining comprises a first network of pneumatic chambers, the plurality of squared or circular openings extending through the inflatable lining in order to allow ambient air to circulate through the inflatable lining; and an intermediate wall sandwiched between the upper and lower layers and affixed along the periphery of the upper and lower layers, the lower layer and the intermediate wall forming together a second network of pneumatic chambers configured to circulate and distribute hot or cold air towards a user laid in a bed under the lower layer so as to regulate the temperature of the duvet; and an air blower configured to be operatively connected to the first network of pneumatic chambers of the inflatable lining for blowing air into the first network of pneumatic chambers, so as in use, the first network of pneumatic chambers of the inflatable lining is inflated to allow for the duvet and its cover to be straightened back into position after every use of the duvet, the air blower being further configured to be operatively connected to the second network of pneumatic chambers to circulate and distribute the hot or cold air therein.

11. The bedding system of claim 10, wherein the inflatable lining further comprises:

a valve configured to receive air from the air blower via a connecting tube and fluidly connected to the first network of pneumatic chambers of the inflatable lining for inflating the first network of pneumatic chambers of the inflatable lining, and to let the air to escape the first network of pneumatic chambers of the inflatable lining when the air blower stops for deflating the first network of pneumatic chambers of the inflatable lining when the duvet and its cover are back into position.

12. The bedding system of claim 10, wherein the second network of pneumatic chambers comprises at least two separate sub-networks of pneumatic chambers for distributing air with different temperatures in specific regions of the bed.

13. The bedding system of claim 10, wherein the lower layer of the inflating lining further comprises a plurality of holes in connection with the second network for distributing the temperature controlled air towards the user.

14. The bedding system of claim 10, wherein the upper and lower layers are affixed together along the periphery thereof via a lateral vertical wall made of an extensible material, so as when the first network of pneumatic chambers of the inflatable lining is inflated, the lateral wall extends to straighten the inflatable lining back into position, and when the air blower stops injecting air into the first network of pneumatic chambers of the inflatable lining, the extensible lateral wall creates a force that, in connection with the valve, allows the inflatable lining to deflate to provide a natural look to the duvet back into position.

15. The bedding system of claim 10, wherein the inflatable lining comprises non-permanent attaching elements for attaching the inflatable lining to the duvet cover or the duvet.

16. The bedding system of claim 10, wherein the air blower is configured to be activated for a given amount of time to send air into said first network of pneumatic chambers.

17. The bedding system of claim 10, wherein the air blower is controlled via an application connected over a network to the apparatus or by a hard wired controller on the apparatus.

18. The bedding system of claim 10, wherein the air blower is controlled by either Bluetooth or WIFI via an application installed on a computer, Smartphone or tablet.

* * * * *